US005201468A

United States Patent [19]

Freier et al.

[11] Patent Number: 5,201,468

[45] Date of Patent: Apr. 13, 1993

[54] PULSATING FLUID SPRAY APPARATUS

[75] Inventors: Donald P. Freier, Sheboygan; Jay K. Wissmueller, Grafton; John Rudelick, Milwaukee, all of Wis.

[73] Assignee: Kohler Co., Kohler, Wis.

[21] Appl. No.: 738,418

[22] Filed: Jul. 31, 1991

[51] Int. Cl.[5] ..... B05B 1/16; B05B 1/18; B05B 3/08

[52] U.S. Cl. ..... 239/383; 239/394; 239/396; 239/449

[58] Field of Search ..... 239/381, 382, 383, 394, 239/396, 448, 449; 384/121, 625

[56] References Cited

U.S. PATENT DOCUMENTS

| | | | |
|---|---|---|---|
| 166,654 | 8/1875 | Thomson . | |
| 170,397 | 11/1875 | Reid . | |
| 2,878,066 | 3/1959 | Erwin | 299/141 |
| 3,173,614 | 3/1965 | Aghnides | 239/429 |
| 3,473,736 | 10/1969 | Heitzman | 239/101 |
| 3,568,716 | 3/1971 | Heitzman | 137/624.14 |
| 3,711,029 | 1/1973 | Bartlett | 239/394 |
| 3,713,587 | 1/1973 | Carson | 239/383 |
| 3,762,648 | 10/1973 | Deines et al. | 239/383 |
| 3,801,019 | 4/1974 | Trenary et al. | 239/383 |
| 3,958,756 | 3/1976 | Trenary et al. | 239/102 |
| 3,963,179 | 6/1976 | Tomaro | 239/101 |
| 3,967,783 | 7/1976 | Halsted et al. | 239/102 |
| 4,010,899 | 3/1977 | Heitzman | 239/101 |
| 4,068,801 | 1/1978 | Leutheuser | 239/102 |
| 4,081,135 | 3/1978 | Tomaro | 239/102 |
| 4,089,471 | 5/1978 | Keonig | 239/381 |
| 4,094,468 | 6/1978 | Volle | 239/394 |
| 4,141,502 | 2/1979 | Grohe | 239/381 |
| 4,187,986 | 2/1980 | Petrovic | 239/449 |
| 4,190,207 | 2/1980 | Fienhold et al. | 239/447 |
| 4,203,550 | 5/1980 | On | 239/102 |
| 4,204,646 | 5/1980 | Shames et al. | 239/443 |
| 4,209,132 | 6/1980 | Kwan | 239/381 |
| 4,219,160 | 8/1980 | Allred, Jr. | 239/447 |
| 4,254,914 | 3/1981 | Shames et al. | 239/383 |
| 4,303,201 | 12/1981 | Elkins et al. | 239/383 |
| 4,330,089 | 5/1982 | Finkbeiner | 239/383 |
| 4,398,669 | 8/1983 | Fienhold | 239/447 |
| 4,579,284 | 4/1986 | Arnold | 239/381 |
| 4,588,130 | 5/1986 | Trenary et al. | 239/381 |
| 4,598,866 | 7/1986 | Cammack et al. | 239/447 |
| 4,629,125 | 12/1986 | Liu | 239/443 |
| 4,666,318 | 5/1987 | Harrison | 384/625 |
| 4,674,687 | 6/1987 | Smith et al. | 239/447 |
| 4,754,928 | 7/1988 | Rogers et al. | 239/381 |
| 4,801,091 | 1/1989 | Sandvik | 239/381 |
| 4,973,068 | 11/1990 | Lebeck | 384/625 X |
| 5,019,738 | 5/1991 | Weilbach et al. | 384/625 X |
| 5,127,580 | 7/1992 | Fu-I | 239/449 |

FOREIGN PATENT DOCUMENTS

| | | | |
|---|---|---|---|
| 0193138 | 9/1966 | European Pat. Off. . | |
| 1027364 | 4/1958 | Fed. Rep. of Germany . | |
| 2511429 | 9/1976 | Fed. Rep. of Germany . | |
| 2644765 | 4/1977 | Fed. Rep. of Germany . | |
| 2821195 | 11/1979 | Fed. Rep. of Germany . | |
| 2911405 | 9/1980 | Fed. Rep. of Germany . | |
| 3245756 | 6/1984 | Fed. Rep. of Germany . | |
| 3706320 | 3/1988 | Fed. Rep. of Germany . | |
| 2068778 | 8/1981 | United Kingdom . | |
| 2081607 | 2/1982 | United Kingdom . | |
| 2121319 | 12/1983 | United Kingdom | 239/383 |
| 2137902 | 10/1984 | United Kingdom . | |

*Primary Examiner*—Andres Kashnikow
*Assistant Examiner*—William Grant
*Attorney, Agent, or Firm*—Quarles & Brady

[57] ABSTRACT

A fluid spray apparatus has an inlet assembly and an outlet assembly that are rotatable with respect to each other. The inlet assembly attaches to a fluid supply and has an outlet opening through which the fluid passes. The outlet assembly has a plurality of inlets positioned to communicate with the outlet opening as the outlet assembly is rotated into different positions with respect to the inlet assembly. Each inlet communicates with a different passage through the outlet assembly and has a set of openings that form a unique spray pattern. One of the fluid passages includes a circular chamber in which a forced vortex is created by the fluid flow. A turbine valve is disposed in the chamber and is driven by the vortex to alternately cover and expose one set of openings. The turbine valve and a chamber wall have rough textured surfaces to reduce friction. The turbine valve is made of an acetal plastic filled with silicone and polytetrafluorethylene to further reduce friction. Appropriate selection of the sizes of inlet and outlet openings of the chamber regulates the pressure therein and optimizes the turbine operation.

17 Claims, 4 Drawing Sheets

PULSATING FLUID SPRAY APPARATUS

BACKGROUND OF THE INVENTION

The present invention relates to fluid spray discharge apparatus; and more particularly to such apparatus which allow a user to select from a variety of fluid discharge spray patterns, one of which being a pulsating pattern.

Various types of fluid spray discharge apparatus have been devised for use as showerheads or spray nozzles at a sink. Such devices often allow the user to adjust the characteristics of the spray emitted by the apparatus by operating a lever or external ring around the device. One common technique for altering the characteristics of the output spray involves passing the fluid through a series of orifices in a member. A plate abuts the member and is connected to and activated by the lever or ring. This plate has a number of elongated apertures, the transverse dimension of which varies along the aperture's length. The plate is moved in relation to the orifices so that the apertures present varying size openings to the orifice, thereby adjusting the spray volume. Further rotation of the plate can block some of the orifices while opening other ones, thereby selecting different orifices of the apparatus which changes the spray pattern.

Previous designs utilized complex gear and shaft mechanisms to couple the lever or ring to the aperture plate that controlled the fluid flow. Such complex mechanisms increase the cost of the product, as well as its likelihood of failure. Therefore, it is desirable to provide as simple a spray selection mechanism as possible both for manufacturing cost saving and greater reliability.

In many spray apparatus, one of the orifices connects to a chamber within which a turbine valve rotates under the force of the water flow. As the turbine valve rotates, a plate on the valve alternately opens and closes different outlets from the chamber. This action produces a pulsating water flow through the outlets. The water forces the turbine valve against the surface of the chamber producing friction which impedes the rotation of the valve. Under low flow rates, this friction often is sufficient to inhibit valve rotation and thereby eliminate the pulsating action.

Various techniques have been devised to reduce the friction between the turbine valve and the wall of its chamber. In one technique, the wall has raised pads at the location of the outlet opening so that the turbine rides against the smaller surface of these pads, thereby reducing the frictional force to which the turbine valve is subjected. Additional structure in the form of ribs extending between the pads guide the valve plate from one raised pad to the next.

SUMMARY OF THE INVENTION

A fluid spray apparatus, such as a showerhead, has an inlet assembly connected to an outlet assembly. The inlet assembly includes a means for connecting a fluid supply to an inlet housing which has an outlet aperture in one surface.

The outlet assembly abuts the one surface of the inlet assembly and is able to rotate against that surface. A body of the outlet assembly has a plurality of inlet openings positioned to communicate with the aperture in the inlet assembly when said outlet assembly is rotated into different positions. The body has a discharge section in which a like plurality of groups of outlets are defined to produce different fluid spray patterns. The outlet assembly also include a means for defining a set of fluid passages with each passage connecting an inlet to an outlet group. By rotating the outlet assembly with respect to the inlet assembly a user is able to select each of the fluid spray patterns.

In the preferred embodiment of the fluid spray apparatus, one of the fluid passages includes a circular chamber in which a forced vortex is created by fluid flow through the passage. The outlets in one of the groups extend through and are spaced circumferentially around a wall of the chamber. A turbine is disposed within said chamber for rotational movement in response to the forced vortex. The turbine has a base plate that serves as a valve to alternately open and close openings to the one group of outlets as said turbine moves within said chamber. This action produces a pulsating fluid flow from those outlets.

The surfaces of the chamber wall and the turbine base plate that come into contact with each other are textured to reduce friction therebetween. As such both surfaces have fine peaks and the components touch at the peaks thereby reducing the surface area of the contact. To reduce friction further, the turbine can be made of a lubricant filled plastic, for example an acetal plastic filled with polytetrafluorethylene and silicone.

The amount of friction also is controlled by regulating the fluid pressure within the chamber. The turbine tends to stall when the pressure is relatively high, while too low a pressure results in leakage under the base plate of the turbine which adversely affects the valving action. The pressure is controlled by proper design of the sizes of outlet and inlet openings to the turbine chamber. A ratio of total outlet opening area to total inlet opening area between four and five is preferred.

DETAILED DESCRIPTION OF THE INVENTION

Figure 2:
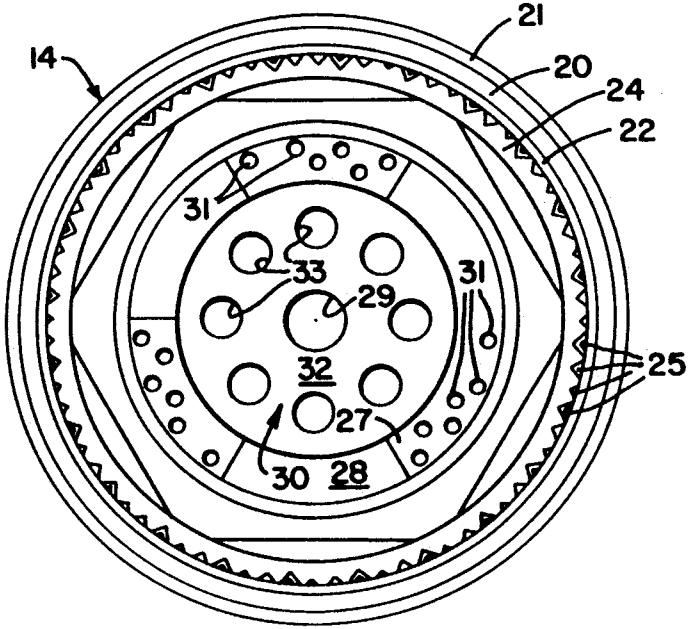
FIG. 2 is a plane view of the outlet end of the showerhead shown in FIG. 1.
Figure 1:
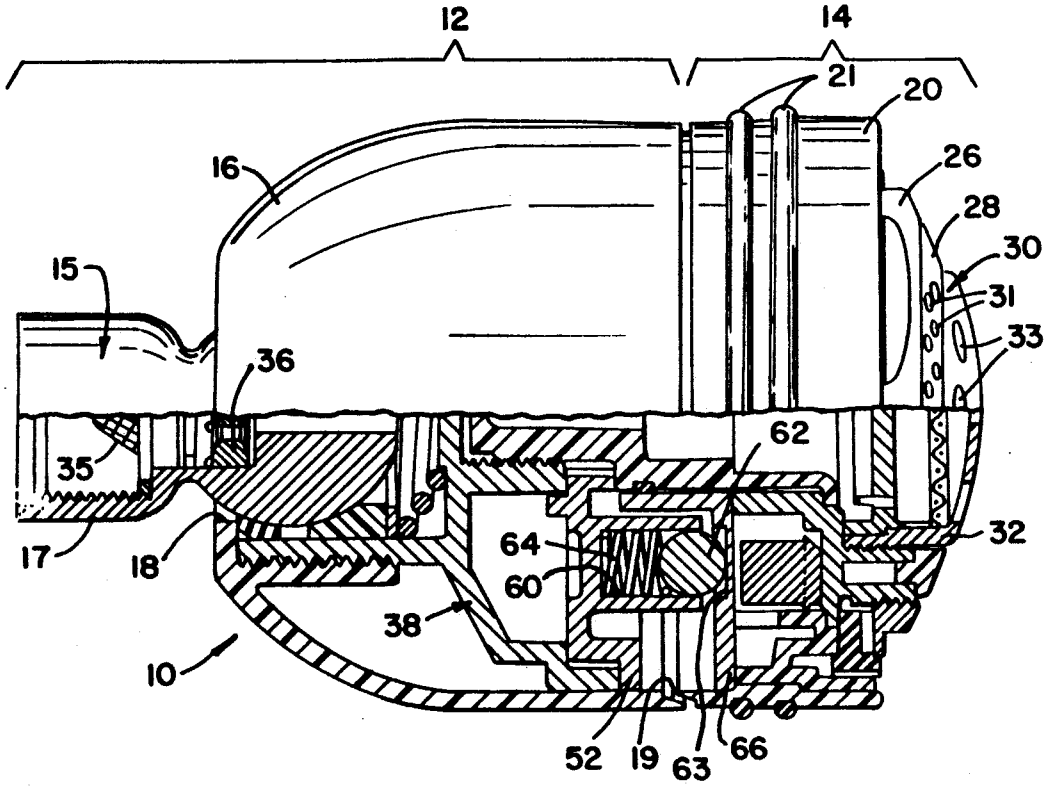
FIG. 1 is a partially cut away view of a showerhead embodiment of a fluid spray discharge apparatus according to the present invention.

With initial reference to FIGS. 1 and 2, a showerhead 10 represents one embodiment of a fluid spray discharge device according to the present invention. The showerhead 10 comprises an inlet assembly 12 and an outlet assembly 14. A user of the showerhead 10 can adjust the spray volume and select among three different spray patterns by rotating the outlet assembly 14 with respect to the inlet assembly 12, as will be described. The components of the showerhead are fabricated of plastic except for metal springs, rubber sealing members, and as otherwise described herein.

The inlet assembly 12 has a metal ball joint 15 which includes a female coupling member 17 having internal threads adapted to mate with a pipe extending from the wall of a shower enclosure. The ball joint 15 has an aperture 34 extending therethrough with a conventional inlet screen 35 and disk 36 located therein. The remaining components of the inlet assembly 12 are contained within a hollow, cylindrical inlet cap 16. The inlet cap 16 has an aperture 18 at one end through which the ball joint 15 passes and a larger aperture 19 at the other end adjacent the outlet assembly 14.

The outlet assembly 14 includes an annular outer shell 20 having two circular grooves around its outer surface. Two rubber grip rings 21 are located within these grooves which provide a surface which the user of the showerhead can grip in order to rotate the outlet assembly 14. The end of the outlet assembly 14 which is remote from the inlet assembly 12 has a large circular opening within which several components are concentrically located. These components create the different spray patterns. The first of these components is a channel ring 22 having an outer cylindrical surface which abuts the inner surface of the outlet shell 20. The exposed end of channel ring 22 has a circular opening within which is positioned a rubber, ring shaped diffuser 24. The outer edge of diffuser 24 has a series of teeth-like grooves which form a first set of spray outlets 25 between the diffuser 24 and the channel ring 22. The diffuser 24 fits around a distributor 28 and is held in place by a hex nut 26 threaded onto a outward cylindrical projection of the distributor 28.

The distributor 28 is welded or cemented within the channel ring 22 to form a flow director 27. Both of these components are made of ABS plastic. The distributor 28 has an exposed surface 23 through which a plurality of second outlets 31 extend. The second outlets 31 are contained in three groups spaced equidistantly around the annular distributor 28. Centrally located within the annular distributor 28 is an aerator assembly 30 having a housing 32 with a plurality of third outlets 33 extending therethrough. The third outlets 33 are spaced in a circle about a central opening 29. As will be described, the central opening 29 is an air inlet and the water flows outward through the outlets 33.

Figure 3:
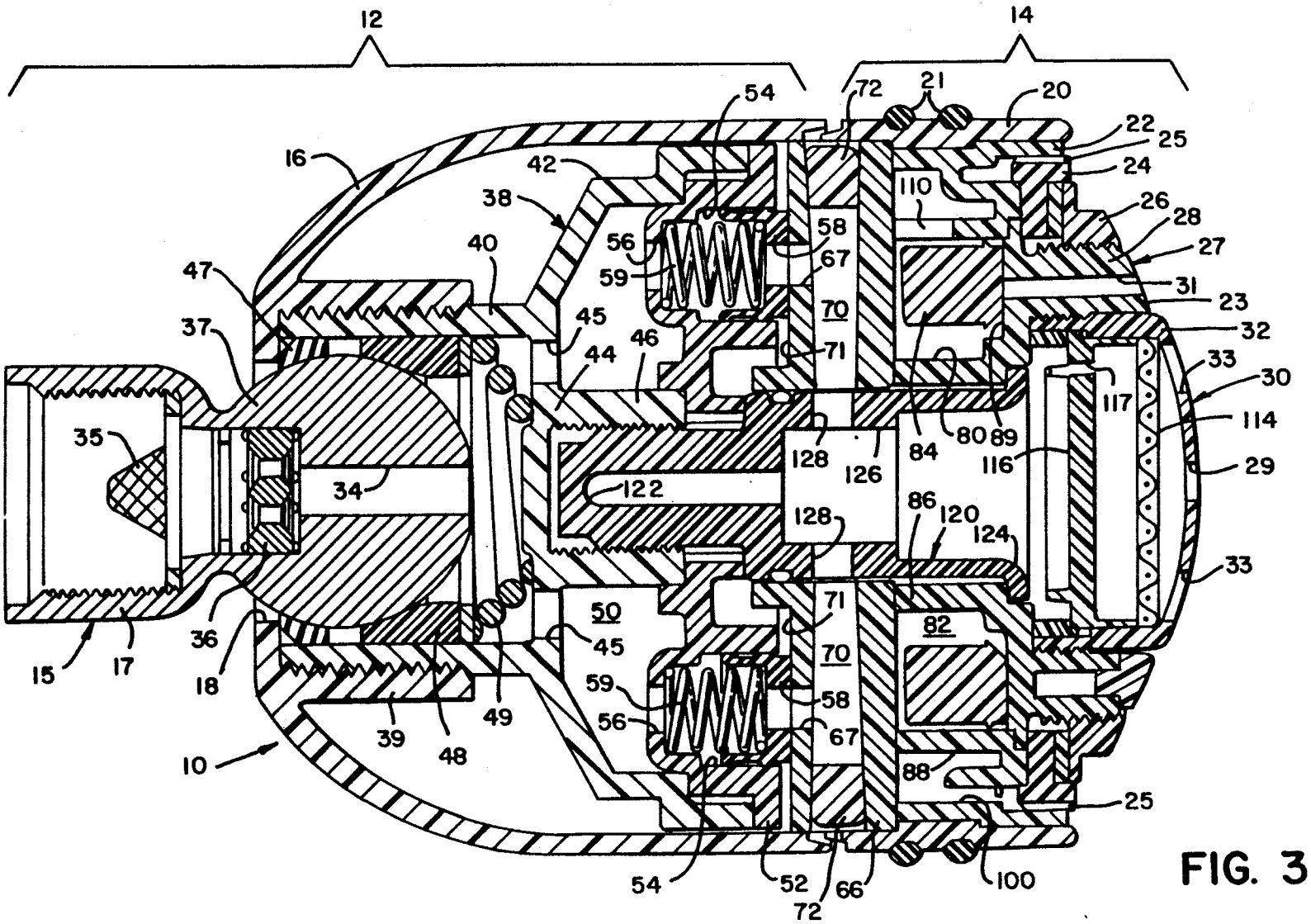
FIGS. 3–5 are longitudinal cross-sectional views of the showerhead oriented in three positions at which different output spray pattern is produced.

With reference to FIGS. 1 and 3, an inlet housing 38 has a tubular portion 40 that threads into a tubular projection 39 inside the inlet cap 16. The inlet housing 38 also has a hollow, conical section 42 extending from the tubular portion 40 and an internal wall 44 which extends across the junction of the tubular portion 40 to the conical section 42. The internal wall 44 has a number of apertures 45 extending therethrough. A tubular member 46 centrally extends from the wall 44 inside the conical section 42 defining a chamber 50 therebetween.

The ball joint 15 extends through the aperture 18 in the inlet cap 16 with a sphere 37 of the ball joint located inside the tubular portion 40 of inlet housing 38. Although the coupling section 17 is smaller than aperture 18, the sphere 37 has a larger outer diameter so that it does not fit through the aperture. A resilient washer 47 is between the sphere 37 and the inlet cap 16 to prevent contact with and damage to the surface finish of the sphere. An annular gasket 48 is positioned within the tubular portion 40 between the ball joint 15 and wall 44 and is biased against the ball by a compression spring 49. This assembly of components within the tubular portion 40 of the inlet housing 38 forms a watertight pivoted coupling for connecting the showerhead 10 to a water supply pipe. The water flows from the ball joint 15 into the tubular portion 40 and passes through apertures 45 into chamber 50 within the conical section 42.

Chamber 50 is closed by an annular head plate 52 which extends across the interior end of the inlet housing 38 abutting exposed end of the conical section 42 and the tubular member 46 in a manner which provides a fluid tight seal therebetween. For example, the plastic inlet housing 38 and head plate 52 are welded or cemented together. The head plate 52 also forms a wall of the inlet assembly 12 which abuts the outlet assembly 14. Two cylindrical cavities 54 are formed in the outer surface of the head plate 52 and have apertures 56 through which the chamber 50 communicates with each cavity. A separate annular inlet seal 58 lies within each cavity 54 and is biased outward by a compression spring 59.

As shown in FIG. 1, another cavity 60 is provided in the head plate 52 in a radially spaced relationship to the two cavities 54. A ball bearing 62 is located within cavity 60 and is biased outwardly therefrom by spring 64. The ball bearing 62 rides against a selector plate 66 which forms an inner wall of the outlet assembly 14. As previously noted, three different spray patterns of the showerhead are selected by rotating the outlet assembly 14 with respect to the inlet assembly 12. At the center point of the rotational travel, where one of the three spray patterns is selected, the ball bearing 62 falls into a depression 63 in the selector plate 66 (see also FIG. 6) forming a detent that provides sensory feedback to the user when the spray head is in this position. The other two spray patterns are selected by rotating the two assemblies 14 and 12 into their extreme positions in opposite directions as will be described subsequently. Rotational stops 65 in FIG. 6 strike the walls which form the cavities 54 and thereby define each of these extreme positions.

Figure 4:
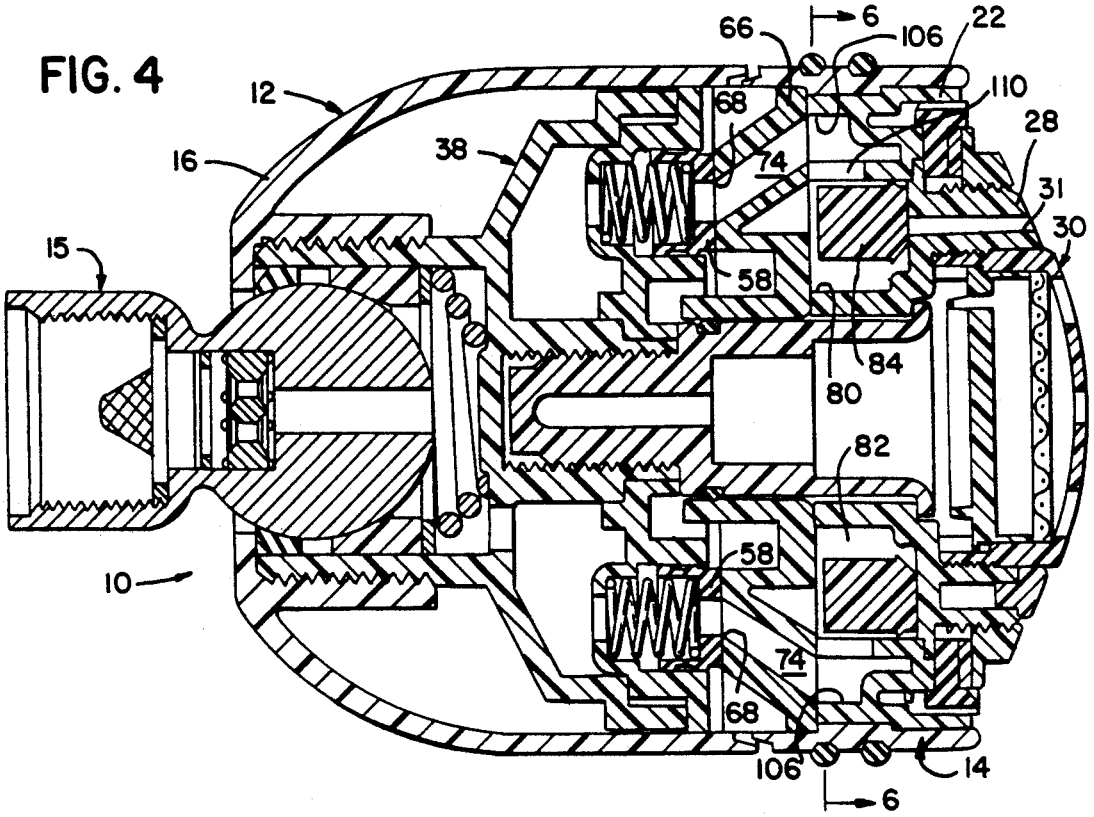
Figure 5:
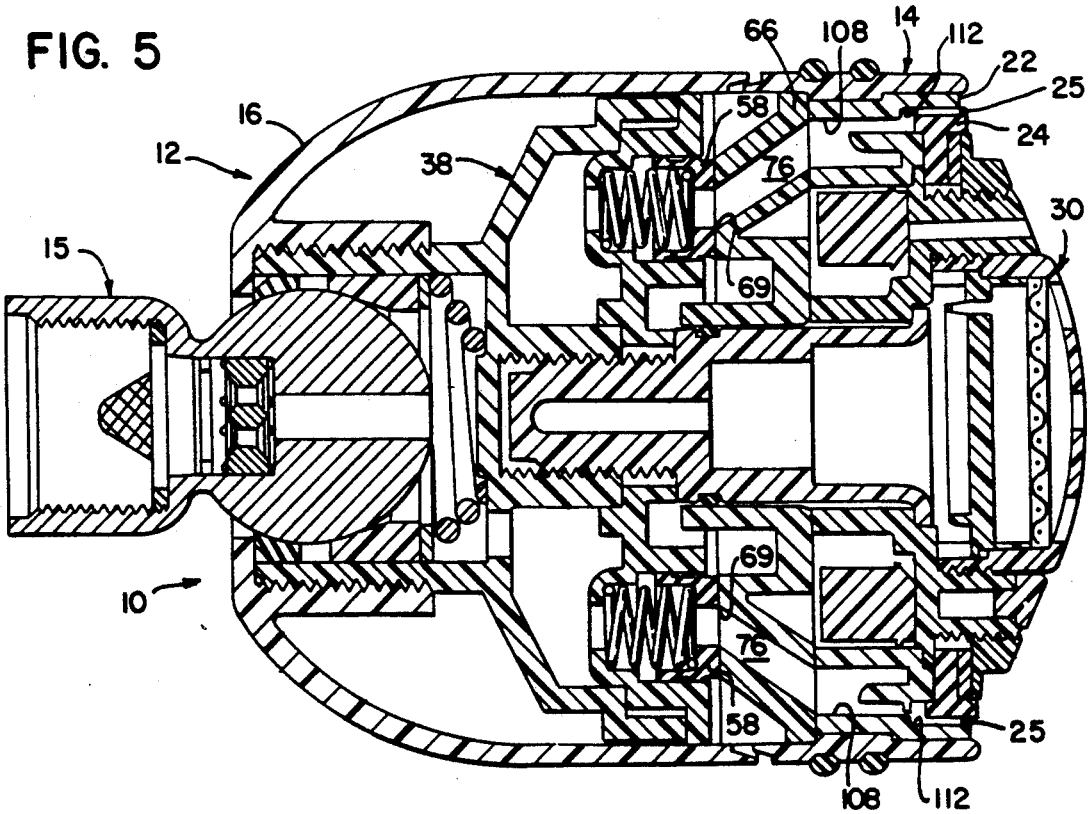

With reference to FIGS. 3–6, the selector plate 66 of outlet assembly 14 has two sets of three outlet apertures 67, 68 and 69 extending therethrough. Each set of apertures is positioned to communicate with one of the rubber inlet seals 58 upon rotation of the outlet assembly. FIG. 3 illustrates a first water passage through the selector plate 66. One of the selector plate apertures 67 in each set communicates with a radially transverse passage 70 on each side of the annular selector plate 66. The outermost ends of channels 70 are sealed by plugs 72, while the innermost ends open into a central aperture through the selector plate 66. The passages 70 permit water entering the selector plate 66 through apertures 67 to flow toward the central aperture. In another rotational orientation of the outlet assembly 14 shown in FIG. 4, the seals 58 of the inlet assembly 12 align with apertures 68 in each set. These apertures communicate with a second passage 74 which is angled outward through the selector plate 66. FIG. 5 shows the alignment of the inlet seals 58 with the third apertures 69 in each set which communicate with another angled passage 76 through the selector plate 66. The passages 70, 74 and 76 form parts of three different fluid paths through the outlet assembly 14.

Figure 7:
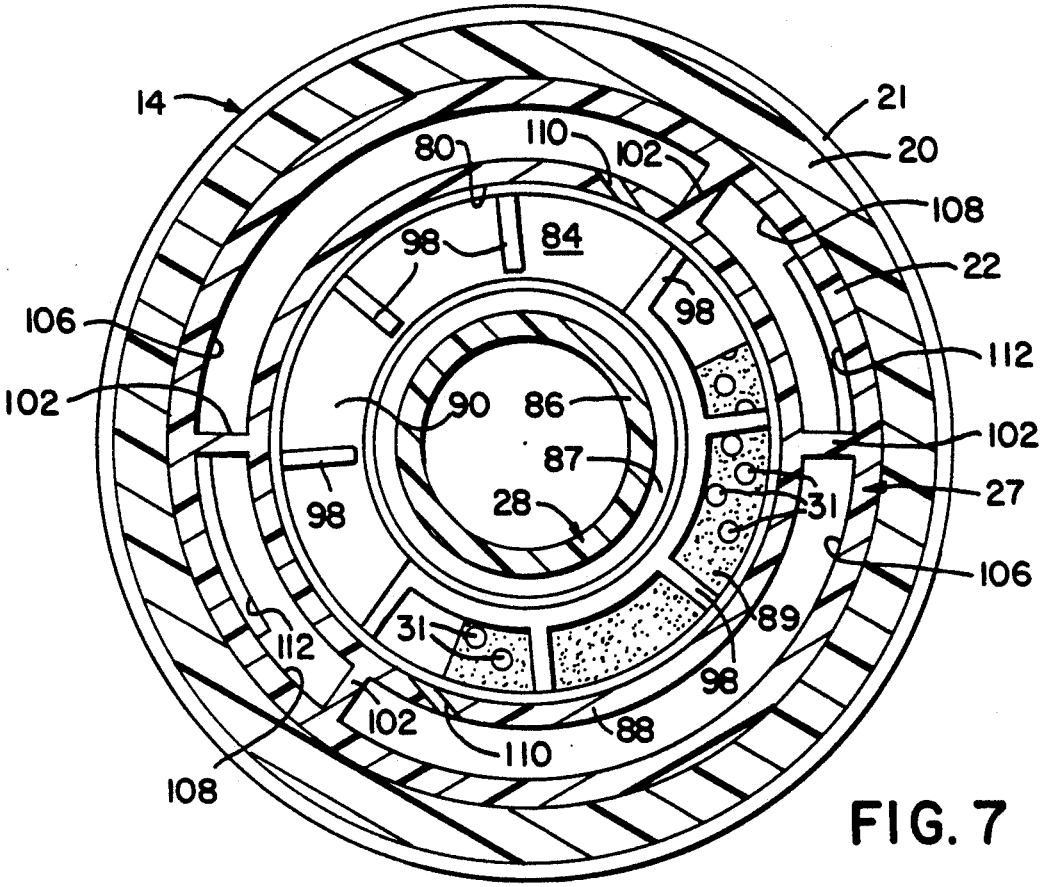
FIG. 7 is a cross-sectional view taken along line 6—6 of FIG. 4.

The other side of the selector plate 66 which is remote from the inlet assembly 12 abuts and is welded or cemented to the inner ends of the channel ring 22 and distributor 28, which form flow director 27 The combination of the channel ring 22 and the distributor 28 form an annular channel 80 which is closed by the selector plate 66 create a circular turbine chamber 82 as shown in FIG. 7 as well. The turbine chamber 82 is defined by an annular wall 86 of distributor 28 and an inner annular wall 88 of channel ring 22. The second fluid outlets 31 extend through a transverse outlet wall 89 of the channel ring 22 thereby providing communication between the turbine chamber 82 and the exterior of the showerhead 10. The inner surface of outlet wall 89 has a 120 micro-inch average roughness surface finish within plus or minus ten percent, as specified in the *Standard Handbook for Mechanical Engineers*, Eight Edition, 1978, McGraw-Hill Book Company This finish creates a texture on the inner surface that is formed by closely spaced peaks. A raised circular hub 87 on the outlet wall 89 extends around the inner wall 87.

Figure 8:
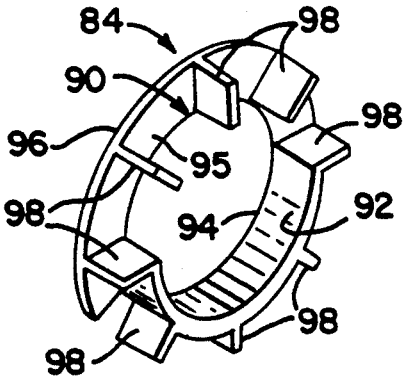
FIG. 8 is a perspective view of the rotary turbine valve of the present showerhead.

A ring-shaped turbine valve 84, shown in FIGS. 7 and 8, fits within the chamber 82 resting against the inner surface of outlet wall 89 and is retained by the two walls 86 and 88 for rotation about a central axis of the showerhead 10. The turbine valve 84 is a single-piece molded element preferably of an acetal plastic filled with silicone and polytetrafluorethylene (PTFE). For example, the plastic turbine valve consists of two percent silicone and fifteen percent polytetrafluorethylene, such as the Lubricomp series plastics manufactured by LNP Engineering Plastics of Exton, Pa., U.S.A. The silicone and PTFE act as a lubricant in reducing friction between the turbine valve and the chamber walls. The turbine valve 84 has a flat generally C-shaped base portion 90 which lies in a radial central plane and extends for approximately 232 degrees about its central axis. A semi-circular curved wall 92 is integrally joined to the opposite ends of base plate 90 and extends circumferentially around the remaining 128 degrees of the turbine valve 84. Edge 94 of wall 92 is coplanar with the interior surface 95 of base plate 90 so that the latter element has the opposite outer surface 96 spaced from the wall edge 94. The outer surface 96 has a surface roughness complying with standard index SPE-SPI No. 5 for plastic material as promulgated by the Society of Plastics Enginners and the Society of the Plastics Industry. Thus the base plate 90 is formed with fine, closely spaced peaks on its outer surface 96.

A plurality of radially extending blades 98 are mounted integrally upon and circumferentially spaced about base plate 90 and curved wall 92 in a symmetrically spaced relationship to the central axis of the turbine valve 84. In the assembled unit illustrated in FIG. 7, the outer surface 96 of the base plate 90 abuts the inner surface of outlet wall 89 of the channel ring 22.

Figure 6:
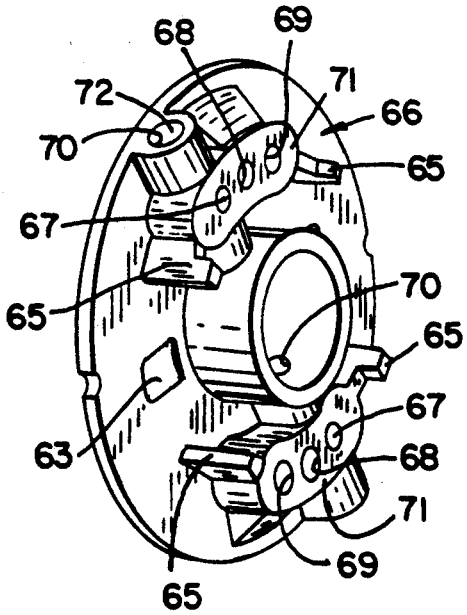
FIG. 6 is a perspective views of the selector plate of the showerhead.

The channel ring 22 has an outer circular wall 100 spaced from the intermediate wall 88 with four radial walls 102 extend between the intermediate and outer walls at different angular positions. The combination of walls 88, 100 and 102 form two pairs of troughs 106 and 108 in the channel ring 22. A tangentially oriented nozzle 110 provides a passage between the two troughs 106 and the turbine chamber 82. As will be described, water flows from the troughs 106 through the nozzles 110 producing streams that strike the blades 60 causing the turbine valve 84 to spin in a clockwise direction in the orientation illustrated in FIG. 7. The other troughs 108 have outlet openings 112 in their periphery as shown in FIGS. 5 and 6. These outlet openings 112 communicate with the grooves in the outer surface of the diffuser 24.

Referring to FIG. 3, the aerator assembly 30 is formed by the cap-like aerator housing 32 and a conventional screen 114 and an aperture aerator plate 116 located in the aerator housing. The aerator housing 32 has external threads which engage internal threads in the surface of a central opening through the distributor 28. The combination of aperture plate 116 and screen 114 cause air which enters the central opening 29 in the aerator housing 32 to be mixed with the water streams that flow through holes 117 in plate 116 and then out the third fluid outlets 33.

The inlet and outlet assemblies 12 and 14 are held together by a center post 120. One end 122 of the center post 120 has external threads which engage internal threads in the inner tubular member 46 of the inlet housing 38. The other end 124 of center post 120 is flared outward and engages a circular notch in the surface of the central opening through the distributor 28 to hold the outlet assembly 14 against the inlet assembly 12. In the assembled state, the selector plate 66 pushes the inlet seals 56 into the depressions 54 in head plate 52. The springs 59 bias the inlet seals 58 against the adjacent surfaces 71 of the selector plate 66 and also seal the depressions 54 providing a watertight passage from the inlet to the outlet assemblies.

The center post 120 has a central aperture 126 extending longitudinally from the flared end 124 and having a hexagonal cross section into which a tightening tool can be inserted. A pair of transverse apertures 128 extend through the center post at positions along the length of the post 120 so that in the assembled showerhead 10 the transverse apertures 128 will communicate with transverse passages 70 in the selector plate 66.

The present showerhead 10 is connected to a water supply by threading the coupling section 17 of the ball joint 15 onto the end of a supply pipe (not shown). Water flows from the pipe into the ball joint 15 passing through screen 35 and disk 36 into the aperture 34. The water then exits aperture 34 into the tubular portion 40 of the inlet housing 38. The water continues to flow through the spring 49 and apertures 45 into cavity 50 that is defined by the conical section 42 of the inlet housing 38 and head plate 52. From cavity 50, the water continues through the apertures 56 in the head plate 52 and springs 59 flowing out of the inlet assembly 12 through the apertures in the inlet seals 58. As the water exits the inlet seals 58, it enters the outlet assembly 14.

The path of the water through the outlet assembly 14 depends upon the orientation of that assembly with respect to the inlet assembly 12. At three different rotational orientations of the outlet assembly 14 to the inlet assembly 12, the apertures of two inlet seals 58 align with different ones of three apertures 67, 68 and 69 in each half of the selector plate 66 of the outlet assembly. As depicted in FIGS. 3, 4 and 5, apertures 67, 68 and 69 communicate with separate passages through the outlet assembly 14 to define three different spray patterns emitted by the showerhead 10. Although there are three angular positions between the outlet assembly 14 and the inlet assembly 12 in which the apertures in each assembly are aligned, intermediate positions exist at which restricted amounts of water flow from the inlet assembly to the outlet assembly. Selection of these intermediate positions allows the user to regulate the flow volume of the water emitted by the showerhead 10.

In the rotational orientation of the outlet assembly 14 with the inlet assembly 12 depicted in FIG. 3, the inlet seals 58 are aligned with the first pair of apertures 67 in the selector plate 66. In this orientation, the water flowing out of the inlet seals 58 enters the two transverse passages 70 in the selector plate 66 and flows toward the center of the showerhead 10. The water continues through transverse apertures 128 in post 120 into longitudinal aperture 126 and out of the flared end 124 into the aerator assembly 30. The water passes through apertures 117 near the outer periphery of aerator plate 116 which are generally aligned with the third outlets 33 in the aerator housing 32. As the water flows between screen 114 and the aerator plate 116, it mixes with air that enters through the central opening 29 in the aerator housing 32 to produce a soft, bubbly stream of water emitted from each outlet 33. These bubbly streams form one of the spray patterns selectable by the user.

Another rotational orientation of the inlet and outlet assemblies 12 and 14 is represented in FIG. 4. In this orientation, the water flowing from the inlet seals 58 passes through another pair of apertures 68 in the selector plate 66 of the outlet assembly 14. Each of these apertures 68 communicates with a set of second passages 74 which angle outward through the selector plate 66. The other ends of the second passages 74 communicate with the first set of troughs 106 in the channel ring 22. Referring to FIG. 7 as well as FIG. 4, the water entering the two troughs 106 travels laterally around the channel ring 22 and through the tangential nozzles 110 into the turbine chamber 82. The nozzles 110 are angled with respect to a radial line from the center of the distributor 28 to produce a vortex within chamber 82. The water stream emitted from a nozzle 110 strikes the blades 60 causing the turbine valve 84 to spin within chamber 82. As the turbine valve 84 spins, the base plate 90 passes over the openings to the second outlets 31 in the distributor 28. This action alternately opens and closes each outlet opening producing a pulsating stream of water. This pulsating stream is another spray pattern produced by the showerhead 10.

As the water flows through the chamber 82, the turbine valve 84 is forced against the inner surface of distributor outlet wall 89. This force tends to impede the rotational movement of the turbine valve 84. However, as noted previously, the abutting surfaces of the turbine valve 84 and wall 89 have specific surface roughness or textures which have been chosen to reduce the friction between these components. Specifically, the surface of outlet wall 89 has a 120 micro-inch average roughness which results in a series of surface peaks against which the valve base plate 90 rides. Similarly, the surface 96 of the turbine valve 84 has a somewhat smoother textured surface defined by an industry standard finish for plastics designated SPE-SPI No. 5. These textured surfaces have fine, closely spaced peaks and the two components contact each other at their peaks, thereby reducing the surface area of the contact and the friction therebetween. In addition, the turbine valve 84 is fabricated from a silicone and polytetrafluorethylene filled acetal plastic to further reduce the friction as the turbine valve spins.

The amount of friction also is controlled by regulating the fluid pressure within the turbine chamber 82. The turbine valve 84 tends to stall when the pressure is relatively high, while too low a pressure results in leakage under the base plate 90 of the turbine which adversely affects the valving action. The relative size of the inlet nozzles 110, and the number and size of the second outlets 31 are chosen to produce a functional pressure within the turbine chamber 82. A ratio of total outlet opening area to total inlet opening area between four and five is preferred.

With reference to FIGS. 5 and 7, the third orientation of the outlet assembly 14 with the inlet assembly 12 aligns the apertures in the inlet seals 58 with the third pair of apertures 69 in the selector plate 66. These apertures 69 communicate with a second set of outwardly extending passages 76 which open into the other pair of troughs 108 in the channel ring 22. The water flows through the troughs 108 and outlet openings 112 in the outer periphery of the bottom of each trough. As shown specifically in FIG. 5, the outlet openings 112 communicate with the outlets 25 formed by the sawtooth grooves in the diffuser 24. This produces a large number of very fine spray streams which form the third spray pattern produced by the showerhead 10.

Although the present invention has been described in the context of a showerhead that is attached to a water supply pipe, the novel concepts can be incorporated in a hand held shower spray head and other spray discharge devices.

We claim:

1. In a fluid spray apparatus that includes a housing having a fluid inlet and a fluid discharge outlet, means in said housing defining a flow path from the inlet to the outlet, and a pulsating means in said flow path for cyclically interrupting the fluid flow from the inlet to the outlet and causing a pulsating spray to be discharged from the apparatus; an improvement wherein said pulsating means comprises:

a means that forms a circular chamber in which a forced vortex is created by fluid flow from the inlet to the outlet, a wall of said chamber having a plurality of circumferentially spaced apertures therethrough which form the outlet, and an interior surface of the wall having a rough textured surface; and a turbine disposed within said chamber for rotational movement in response to the forced vortex, said turbine having a base plate which serves as a valve to alternately cover and expose the apertures as said turbine moves within said chamber, a surface of the base plate which contacts the interior surface of the wall also having a rough textured surface;

the textures of said surfaces cooperating to reduce friction between said turbine and the wall of said chamber.

2. The fluid spray apparatus as recited in claim 1 wherein the texture of the interior surface of the wall has substantially a 120 micro-inch average roughness.

3. The fluid spray apparatus as recited in claim 1 wherein the texture of said turbine substantially conforms to standard finish for plastics designated SPE-SPI No. 5.

4. The fluid spray apparatus as recited in claim 1 wherein said turbine is made of a silicone filled plastic.

5. The fluid spray apparatus recited in claim 1 wherein said turbine is made of a polytetrafluorethylene filled plastic.

6. The fluid spray apparatus as recited in claim 1 wherein said turbine is made of an acetal plastic filled with a lubricant.

7. The fluid spray apparatus as recited in claim 1 wherein a ratio of total area of outlet openings from the chamber to total area of inlet openings into the chamber is between four and five inclusive.

8. A fluid spray apparatus comprising:

an inlet assembly having a first chamber therein, a means for coupling the first chamber to a fluid supply, a pair of fluid passages from the first chamber through a wall of said assembly, and separate sealing means with an aperture therethrough disposed in each passage and biased outwardly therefrom by a spring;

an outlet assembly abutting said inlet assembly and being rotatably attached thereto, said outlet assembly including:

a body having a plurality of pairs of inlets with each pair positioned to communicate with the pair of fluid passages when said outlet assembly is rotated into different positions with respect to said inlet assembly, said body having a discharge section in which a like plurality of groups of outlets are defined, each group of outlets create a different fluid spray pattern;

means for defining a set of fluid passageways with each passageway connecting an inlet to a group of outlets wherein one of the fluid passageways includes a circular second chamber in which a forced vortex is created by fluid flow through the passageway, and outlets of one group extend through and are circumferentially spaced about a wall of said second chamber; and a turbine disposed within said second chamber for rotational movement in response to the forced vortex, said turbine having a base plate that serves as a valve to alternately cover and expose outlets of the one group as said turbine moves within said second chamber, a surface of the base plate which contacts the wall of said second chamber having a rough textured surface;

wherein a surface of the wall of said second chamber has a rough textured surface with peaks to reduce resistance to movement between said turbine and the wall.

9. The fluid spray apparatus as recited in claim 8 wherein said turbine is made of an acetal plastic filled with a lubricant.

10. A fluid spray apparatus comprising:

an inlet assembly including:

a cap with a centrally located, internal tubular projection, an inlet housing within said cap and having a tubular member that engages the tubular projection, and having a hollow conical section extending from one end of the tubular member, a means disposed in the tubular member for coupling said apparatus to a fluid supply, and a head plate extending across an end of the conical section that is remote from the tubular member, and having a passageway therethrough;

an outlet assembly abutting said inlet assembly and being rotatably attached thereto, said outlet assembly including:

a selector plate having three fluid passages therethrough each being positioned to communicate with the head plate passageway when said outlet assembly is rotated into a different angular position with respect to said inlet assembly, each fluid passage having a outlet opening, a flow director abutting said selector plate and having two fluid paths therethrough, each path communicating with the outlet opening of a different fluid passage in said selector plate and having a number of outlets that form a spray pattern, one of the paths has a chamber in which a forced vortex is created by fluid flow and has outlets opening through a wall of the chamber;

a turbine disposed within the chamber for rotational movement in response to the forced vortex, and having a base plate which serves as a valve to alternately cover and expose the outlets through the wall of the chamber as said turbine moves;

a post which engages both the inlet and outlet assemblies in a manner that allows the assemblies to rotate with respect to each other, said post having a longitudinal aperture extending from one end and a transverse aperture coupling a fluid passage to the longitudinal aperture; and an aerator adjacent the one end of said post to receive fluid therefrom.

11. The fluid spray apparatus as recited in claim 10 wherein a surface of the wall of the chamber has a textured surface to reduce friction between said turbine and the wall.

12. The fluid spray apparatus as recited in claim 11 wherein the texture of the surface of the wall substantially has a 120 micro-inch average roughness.

13. The fluid spray apparatus as recited in claim 10 wherein the base plate of said turbine has a textured surface to reduce friction between said turbine and the wall.

14. The fluid spray apparatus as recited in claim 13 wherein the texture of the base plate surface substantially conforms to a standard finish for plastics designated SPE-SPI No. 5.

15. The fluid spray apparatus as recited in claim 10 wherein said turbine is made of a lubricant filled plastic.

16. The fluid spray apparatus as recited in claim 10 wherein said turbine is made of a polytetrafluorethylene filled plastic.

17. The fluid spray apparatus as recited in claim 10 wherein said turbine is made of an acetal plastic filled with silicone and polytetrafluorethylene.

* * * * *